US007160173B2

(12) United States Patent
Palmgren

(10) Patent No.: US 7,160,173 B2
(45) Date of Patent: Jan. 9, 2007

(54) ABRASIVE ARTICLES AND METHODS FOR THE MANUFACTURE AND USE OF SAME

(75) Inventor: Gary M. Palmgren, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/115,538

(22) Filed: Apr. 3, 2002

(65) Prior Publication Data

US 2003/0190868 A1 Oct. 9, 2003

(51) Int. Cl.

| | |
|---|---|
| ***B24B 49/00*** | (2006.01) |
| ***B24B 51/00*** | (2006.01) |
| *B24B 5/00* | (2006.01) |
| *B24B 29/00* | (2006.01) |

(52) U.S. Cl. ..... 451/8; 451/5; 451/287

(58) Field of Classification Search ..... 451/8, 451/5, 41, 63, 285, 287, 539

See application file for complete search history.

(56) References Cited

U.S. PATENT DOCUMENTS

| | | | | |
|---|---|---|---|---|
| 3,656,265 | A | 4/1972 | Schaffner, Jr. | |
| 4,212,135 | A | 7/1980 | Mirsch et al. | |
| 4,351,029 | A | 9/1982 | Maxey et al. | |
| 4,505,074 | A | 3/1985 | Kogure | |
| 4,535,571 | A | 8/1985 | Smith | |
| 4,590,573 | A | 5/1986 | Hahn | |
| 4,900,252 | A | 2/1990 | Liefke et al. | |
| 5,012,989 | A | 5/1991 | Whyte, Jr. et al. | 242/186 |
| 5,152,917 | A | 10/1992 | Pieper et al. | 51/295 |
| 5,177,901 | A | 1/1993 | Smith | |
| 5,441,549 | A * | 8/1995 | Helmin | 51/298 |
| 5,452,150 | A | 9/1995 | Henneberger et al. | 360/74.4 |
| 5,490,878 | A * | 2/1996 | Peterson et al. | 51/295 |
| 5,508,596 | A | 4/1996 | Olsen | |
| 5,514,028 | A | 5/1996 | Ali et al. | 451/539 |
| 5,609,718 | A | 3/1997 | Meikle | |
| 5,643,044 | A | 7/1997 | Lund | 451/5 |
| 5,661,616 | A | 8/1997 | Tran et al. | 360/77.12 |
| 5,725,421 | A * | 3/1998 | Goers et al. | 451/303 |
| 5,738,574 | A | 4/1998 | Tolles et al. | |
| 5,833,519 | A | 11/1998 | Moore | |

(Continued)

FOREIGN PATENT DOCUMENTS

| | | |
|---|---|---|
| DE | 35 18 902 A1 | 11/1986 |

(Continued)

*Primary Examiner*—Lee D. Wilson
*Assistant Examiner*—Alvin J Grant
(74) *Attorney, Agent, or Firm*—Daniel R. Pastirik; Daniel D. Biesterveld

(57) ABSTRACT

The invention provides an abrasive article, and methods for the use and the manufacture of the article. The abrasive article comprises an abrasive surface; and a performance index associated with the abrasive article, the index indicating an aspect of the abrasive performance of the article. In abrasive applications, the performance index is used to determine initial process conditions under which the abrasive article will abrade a workpiece. A process for making the abrasive article comprises (a) providing an abrasive article having an abrasive surface; (b) providing a workpiece having an abradable surface thereon; (c) abrading the abradable surface by applying the abrasive surface against the abradable surface at a known applied pressure and velocity and relatively moving the abrasive article and the abradable surface during a predetermined period of time; (d) devising a performance index based on the abrasive performance of the abrasive article during the abrading step (c); and (e) associating the performance index with the abrasive article.

11 Claims, 2 Drawing Sheets

U.S. PATENT DOCUMENTS

| | | | | |
|---|---|---|---|---|
| 5,897,424 | A | 4/1999 | Evans et al. | 451/41 |
| 6,000,997 | A | 12/1999 | Kao et al. | |
| 6,123,612 | A | 9/2000 | Goers | 451/540 |
| 6,264,533 | B1 * | 7/2001 | Kummeth et al. | 451/8 |
| 6,286,656 | B1 * | 9/2001 | Huang et al. | 198/502.2 |
| 6,293,139 | B1 | 9/2001 | Keller et al. | |
| 6,322,427 | B1 | 11/2001 | Li et al. | |
| 6,475,253 | B1 * | 11/2002 | Culler et al. | 51/295 |
| 6,488,575 | B1 * | 12/2002 | Agarwal et al. | 451/527 |
| 6,564,116 | B1 * | 5/2003 | Wang et al. | 700/121 |
| 6,612,917 | B1 * | 9/2003 | Bruxvoort | 451/533 |
| 2002/0106971 | A1 | 8/2002 | Rodriquez et al. | |
| 2002/0142706 | A1 | 10/2002 | Glashauser et al. | |

FOREIGN PATENT DOCUMENTS

| | | | |
|---|---|---|---|
| DE | 41 11 016 | C1 | 7/1992 |
| EP | 0 447 084 | A1 | 3/1991 |
| EP | 0 630 820 | A1 | 12/1994 |
| EP | 0 881 552 | A2 | 12/1998 |
| EP | 0 893 203 | A2 | 1/1999 |
| EP | 1 063 056 | A2 | 12/2000 |
| EP | 1 099 511 | A2 | 5/2001 |
| WO | WO 99/23449 | | 5/1999 |
| WO | WO 00/35628 | | 6/2000 |

* cited by examiner

ABRASIVE ARTICLES AND METHODS FOR THE MANUFACTURE AND USE OF SAME

The present invention relates generally to abrasive articles having a performance index associated therewith, to a method for manufacturing such abrasive articles, and to a method for the use of such articles.

BACKGROUND OF THE INVENTION

Abrasive articles used in polishing or grinding operations are generally expected to perform their abrasive function with a high degree of precision. However, the abrasive manufacturing process has been known to provide similarly constructed abrasive articles that differ from one another in their performance characteristics. In part, this variability may be caused by variability in the quality and characteristics of the raw materials used to make the abrasive article. Hence, variation in the performance of abrasive articles is an inherent result of the manufacturing process. Moreover, manufacturers of abrasive articles often define their product specifications in a manner that allows for performance variations while providing satisfactory product yields. These variabilities in abrasive articles make it difficult to predict the specific performance of an abrasive article in a particular application even in those cases where the abrasive article is a replacement part for a similarly constructed abrasive article used in the same polishing or grinding process.

Traditional off-hand grinding or polishing processes are normally judged as complete when a desired amount of material is removed from a work surface or when the desired surface finish is attained. The end point of the process may be determined after multiple measurements have been taken at successive intervals during processing. It is becoming increasingly common to replace such off-hand grinding/polishing processes with automated processes that require preset process conditions in the finishing of successive workpieces, and it is desirable to provide abrasive articles in a manner that allows for the adjustment of process conditions prior to the initial use of an abrasive article.

Because of the variations inherent in abrasive article manufacturing, processes using abrasive articles often require an adjustment to the process conditions when the abrasive article is replaced in an existing process line. Changes to such process conditions might include, for example, the pressure at which the abrasive article is applied to a work surface, the contact time or the speed of the abrasive article (e.g., centimeters per minute, rotations per minute, etc.) relative to the workpiece. These adjustments to abrasive process conditions have contributed to lower productivity and higher costs because new process settings have traditionally been determined only after a new abrasive article is inserted in the process line and the performance of the article has been initially observed under the process settings used for the previous abrasive article. This adjustment method can require significant time and effort, and it may cause damage to one or more workpieces during the recalibration. Abrasive process conditions are then adjusted to accommodate the new abrasive article only after the performance of the new article has been observed at least once within the same process line.

Although improvements are needed and desired in the predictability of abrasive performance, new or replacement abrasive articles still require a trial and error evaluation prior to their actual use in an abrasive process line. While manufacturers have marked their abrasive articles with indicia to indicate abrasive grit composition, size, and the like, the abrasive art has failed to develop methods for the manufacture of an abrasive article wherein the article is labeled with a performance index that can be used by an end user of the article to adjust the initial process conditions under which the abrasive article will be used.

The creation and use of a performance index addresses a long felt and unsolved need by providing a means by which the end user of the abrasive article can adjust the initial process conditions prior to the initial use of the abrasive article.

SUMMARY OF THE INVENTION

The present invention provides an abrasive article having a performance index associated therewith. In one aspect, the invention is directed to an abrasive article, comprising an abrasive surface; and a performance index associated with the abrasive article, the index indicating an aspect of the abrasive performance of the article.

The performance index is associated with the abrasive article to provide a means by which the end user of the article can initially determine the process conditions under which the abrasive article is to be operated in an abrasive operation. The abrasive article may comprise any of a variety of abrasive article known to those skilled in the art, and the performance index may be associated with the abrasive article in any manner. For example, the performance index may be associated with the abrasive surface of the article, with the back or other non-abrasive surface, or the index may be associated with the packaging used for shipping, displaying and/or selling the abrasive article.

The performance index may be based on a measured cut rate for the abrasive article on a surface at a known applied pressure and velocity over a predetermined period of time. When based on cut rate, the performance index may represent the cut rate or it may be a ratio of the cut rate to any of (a) the applied pressure, (b) velocity or (c) the predetermined period of time. Alternatively, the performance index may be based on the measured finish on a surface as a result of the abrasive application of the abrasive article on the surface at a known applied pressure and velocity over a predetermined period of time. The performance index may be associated with (e.g., affixed to) the abrasive article, or it may be stored in a database so that the abrasive article includes some marking that will provide a means for accessing the database to obtain the performance index therefrom. Such markings may be in machine readable format such as a bar code, for example.

In another aspect, the invention provides a process for providing the abrasive article described above, the process comprising:

(a) providing an abrasive article having an abrasive surface;

(b) providing a workpiece having an abradable surface thereon;

(c) abrading the abradable surface by applying the abrasive surface against the abradable surface at a known applied pressure and velocity and relatively moving the abrasive article and the abradable surface during a predetermined period of time;

(d) devising a performance index based on the abrasive performance of the abrasive article during the abrading step (c); and (e) associating the performance index with the abrasive article.

In still another aspect, the invention provides a process for abrading a workpiece, comprising:

(a) providing an abrasive article having a performance index associated therewith;

(b) using the performance index to determine process conditions under which the abrasive article is to abrade the workpiece; and (c) relatively moving the abrasive article and the workpiece under the process conditions determined in Step (b).

The numerous features and advantages of the invention will become more apparent to those skilled in the art upon consideration of the remainder of the disclosure including the detailed description and claims taken in conjunction with the accompanying drawings.

BRIEF DESCRIPTION OF THE DRAWINGS

In describing the preferred embodiments of the invention, reference is made to the various Figures wherein like reference numerals indicate like features and in which.

DETAILED DESCRIPTION OF THE PREFERRED EMBODIMENT

The present invention provides an abrasive performance index to be associated with an abrasive article. The index may be determined during the initial manufacture of the abrasive article and provides an end user or the like with a means by which he/she can initially adjust the process conditions in an abrasive (e.g., grinding, fining or polishing) process prior to first using the new abrasive article. Use of the performance index promotes consistent grinding and/or polishing results by facilitating the initial adjustments or changes to process conditions associated with the replacement of the abrasive article.

The performance index of the invention may be utilized in the characterization of grinding, fining and/or polishing articles in various configurations (e.g., endless belts, pads, discs, etc.), and with any type of abrasive article, i.e., coated abrasive articles, surface conditioning articles (e.g., nonwovens), lapping film, grinding wheels, metal bonded abrasives and the like.

Figure 1:
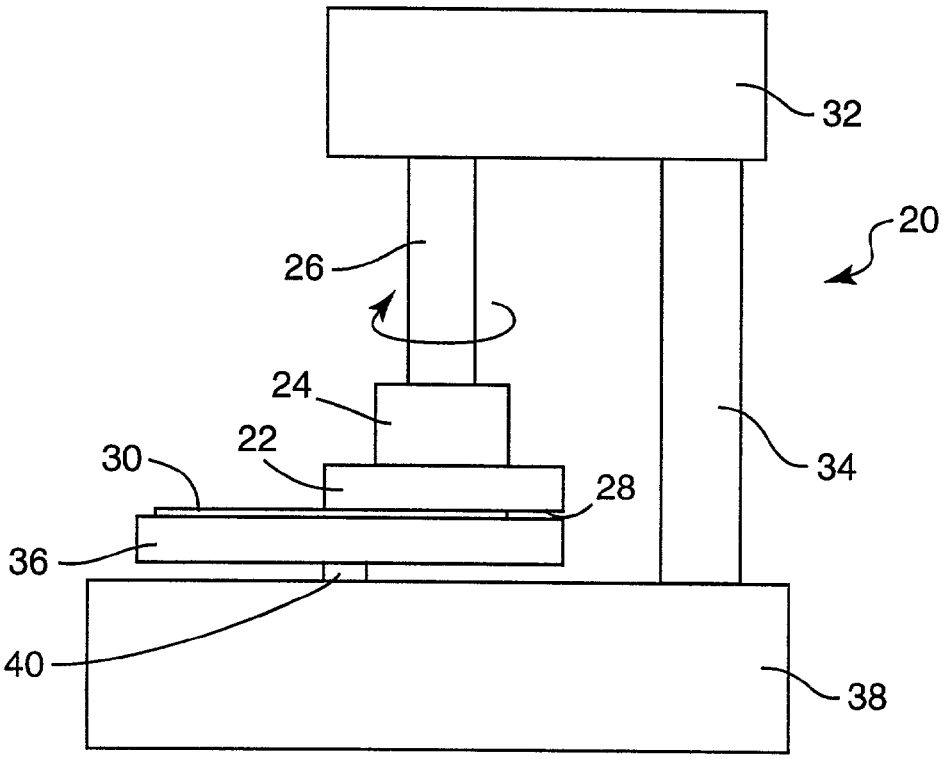
FIG. 1 is a schematic illustrating one embodiment of an apparatus for the determination of a performance index according to the principles of the present invention.

Referring now to the drawings, FIG. 1 schematically illustrates one embodiment of an abrasive testing apparatus 20 for characterizing the performance of an abrasive article 22 to determine a performance index according to the invention. The apparatus 20 may be included directly in the production line for the manufacture of the abrasive article 22 so that the article 22 can be marked with a performance index during the manufacturing operation. The performance index may subsequently be used by the end user to initially adjust the conditions of the polishing or grinding process in which the abrasive article 22 is to be used.

Although the invention is not limited by the type of abrasive article used, the present invention is most conveniently described with reference to abrasive article 22. Such an abrasive article is typically constructed to include a backing with an abrasive surface coated onto the backing. The abrasive surface normally comprises a binder (e.g., polymeric, ceramic, metallic, or the like) and usually includes abrasive particles that will provide a desired surface finish to a workpiece. The abrasive particles may be dispersed throughout the binder, solely along the outermost surface of the binder, or throughout the binder as well as along the outermost surface thereof. The abrasive particles may comprise conventional hard abrasive particles and/or softer abrasive particles including organic and inorganic particles. The abrasive particles may be provided as individual grains, as agglomerates in which the individual abrasive grains are dispersed in a secondary binder system, or as raised composites comprising abrasive grains and/or agglomerates and a binder.

Hard abrasive particles include fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles and the like. Examples of conventional softer inorganic abrasive particles include silica, iron oxide, chromia, ceria, zirconia, titania, silicates and tin oxide. Still other examples of soft abrasive particles include: metal carbonates (such as calcium carbonate (chalk, calcite, marl, travertine, marble and limestone), calcium magnesium carbonate, sodium carbonate, magnesium carbonate), silica (such as quartz, glass beads, glass bubbles and glass fibers) silicates (such as talc, clays, (montmorillonite) feldspar, mica, calcium silicate, calcium metasilicate, sodium aluminosilicate, sodium silicate) metal sulfates (such as calcium sulfate, barium sulfate, sodium sulfate, aluminum sodium sulfate, aluminum sulfate), gypsum, aluminum trihydrate, graphite, metal oxides (such as calcium oxide (lime), aluminum oxide, titanium dioxide) and metal sulfites (such as calcium sulfite), metal particles (tin, lead, copper and the like) and the like.

Softer organic particle include plastic abrasive particles formed from a thermoplastic material such as polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon and combinations thereof. Plastic abrasive particles can also be formed from crosslinked polymers. Examples of crosslinked polymers include phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins and mixtures thereof. These crosslinked polymers can be made, crushed and screened to the appropriate particle size and particle size distribution.

Other abrasive particles and combinations of particles may also be known by those skilled in the art, and the invention is intended to encompass any abrasive article comprising any abrasive particle or combination of abrasive particles.

Abrasive articles may also be made to comprise a textured abrasive surface with or without added abrasive particles either in the binder or dispersed on the outer surface thereof. Likewise, the abrasive surface of the abrasive article may comprise, for example a polymeric material comprising hard and soft segments therein where the hard segments of the polymer provide a desired degree of abrasiveness. One such abrasive article is described in U.S. Pat. No. 6,234,875, incorporated in its entirety herein by reference thereto.

Another abrasive article suitable for use in the invention is a pad conditioner useful in conditioning conventional slurry pads for the chemical mechanical planarization ("CMP") of semiconductor wafers. Suitable pad conditioners include those made according to the disclosure of U.S. Pat. No. 6,123,612, incorporated in its entirety herein by reference thereto. Abrasive articles comprising lapping or burnishing films may also be used in the invention. Such articles include a lapping film product as described in U.S. Pat. No. 5,897,424, incorporated herein in its entirety by reference thereto. Another suitable abrasive article may comprise abrasive composites similar to those described in U.S. Pat. No. 5,152,917, incorporated in its entirety herein by reference thereto. Abrasive articles comprising the aforementioned abrasive composites may be made without abrasive particles.

Figure 2:
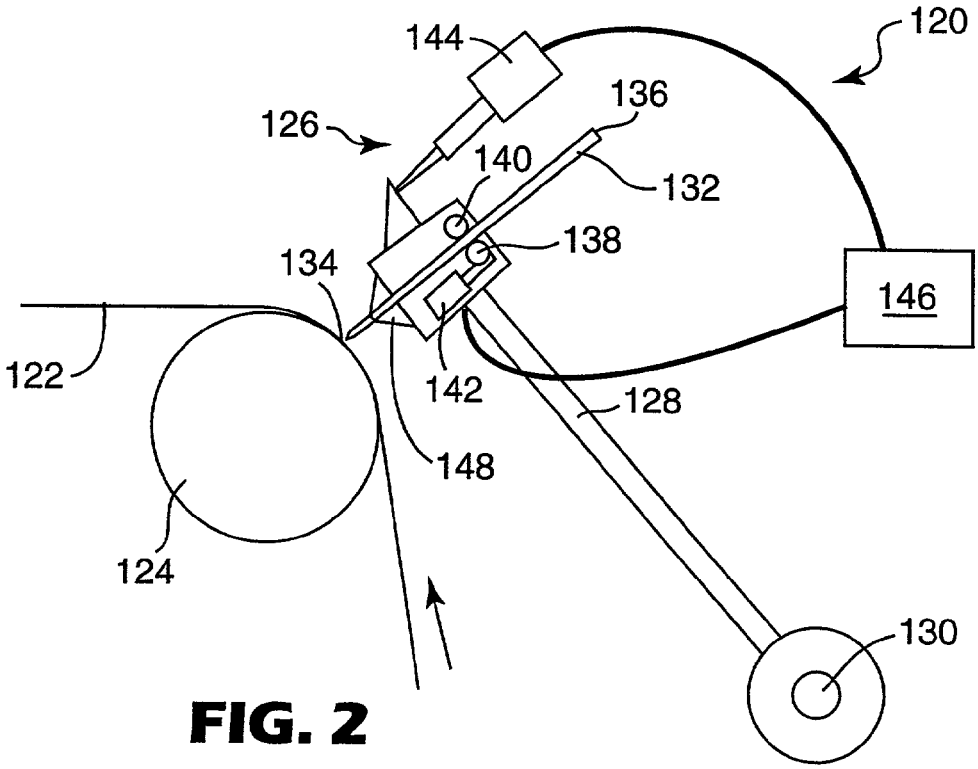
FIG. 2 is a schematic illustrating another embodiment of an apparatus for the determination of a performance index according to the principles of the present invention.

In whatever form, the abrasive article is constructed to grind, polish or otherwise abrade the surface of a workpiece typically with relative movement therebetween to generate the friction required for the desired abrasive application. The test apparatus of FIG. 1 or FIG. 2 are illustrative of available devices for characterizing the performance of an abrasive article under reproducible conditions in accordance with the teachings of the present invention. Other means are also contemplated to characterize the performance of the article.

As shown in FIG. 1, the workpiece 30 is retained on a first retaining means, shown as a platen 36. The abrasive article 22 is positioned within abrasive testing apparatus 20 and is retained in a second retaining means, shown as fixture 24. The fixture 24 and the abrasive article 22 are associated with rotatable shaft 26 and both the article 22 and fixture 24 will co-rotate under power supplied from a motor (not shown) positioned within the housing 32. As mentioned, the apparatus 20 may serve as a test station within a process line for the manufacture of an abrasive article. As a test station, the apparatus 20 is used to evaluate and characterize abrasive articles being manufactured. Such an evaluation or characterization may include, for example, a determination of the cut rate of abrasive article 22 on a test work surface such as the abradable surface of workpiece 30. Other measurements may serve as the basis for a performance index. One such additional measurement is the surface finish that the abrasive article can impart on the test surface, as measured by standard tests in the industry. Other measurements are also contemplated as providing performance indices within the scope of the invention as known by those skilled in the art. Moreover, in some embodiments of the invention, the performance index may be the actual value of the particular measurement (e.g., cut rate, surface finish) or it may be a value or a symbol representative of the measurement or derived therefrom.

In the depicted embodiment, the abrasive article 22 is positioned within a fixture 24 supported at the end of rotatable shaft 26 which extends between the fixture 24 and motor housing 32. A support shaft 34 extends up from the base 38 to the motor housing 32. The housing 32 slides vertically along the shaft 34 to provide a means for moving abrasive article 22 between a first or disengaged position and a second or engaged position (e.g. as shown) relative to the workpiece 30. In this manner, the abrasive surface 28 of the article 22 may be positioned in direct contact with the surface of workpiece 30 so that the abrasive article 22 may abrade the surface of the workpiece 30. The platen 36 carries the workpiece 30 and helps to maintain contact between the workpiece 30 and the abrasive article 22. The platen 36 is also rotatable about the axis of support shaft 40 which may be rotationally driven by a motor (not shown) housed within the base 38. As mentioned, the abrasive article 22 may also be rotated about the rotatable shaft 26 by a second motor positioned in the housing 32 so that both the workpiece 30 and the abrasive article 22 rotate against one another under a predetermined pressure to abrade the workpiece 30. Following the foregoing abrasive operation, the apparatus 20 may be returned to the first position, in which the abrasive article 22 is moved away from the workpiece so that the abrasive surface 28 does not touch the surface of the workpiece 30.

When the apparatus 20 is in the first or disengaged position, the abrasive article 22 and the workpiece 30 may be removed from the apparatus 20 and cleaned or replaced as needed. To allow for the foregoing movement of the abrasive article 22, the housing 32 may be moved vertically along the length of the shaft 34 from the engaged alignment of the second position. Other constructions may be known to those skilled in the art to position the apparatus 20 between the aforementioned first and second positions, and the invention is not limited in any way to the particular configuration shown in FIG. 1 or otherwise discussed herein.

In the configuration of parts shown in FIG. 1, the workpiece 30 comprises a donut-shaped test surface positioned on the rotatable platen 36. The workpiece 30 may comprise any of a variety of materials known to be abradable by the abrasive surface 28 of the article 22. Suitable materials for the workpiece 30 may be chosen according to known criteria such as the consistent quality of commercially available materials, their relative price, and the like. One possible test material is a polymeric material such as polyurethane, for example.

During the abrasive process, a fluid is typically applied between the abrasive article 22 and the workpiece 30 to provide lubrication and to remove the swarf generated by the action of the abrasive article against the workpiece. Suitable lubricants include water, water containing a soluble oil or another suitable fluid as known by those skilled in the art to be compatible with the process. Additional means (not shown) may be provided to deliver the aforementioned fluid to the interface of the article 22 and the workpiece 30.

In operation, the apparatus 20 may be used to determine the cut rate of the abrasive article when applied against the workpiece 30. Alternatively, the apparatus can be used to impart a finish to the workpiece, and the finish can be quantified in a known manner to provide a measure on which the performance index may be based. In this manner, a performance index can be determined and associated with the abrasive article for use by end users. In associating the cut rate of the article with the performance index, the cut rate is determined by applying the abrasive article 22 against the surface of the workpiece for a predetermined period of time. In such a determination, the pressure exerted against the workpiece 30 by the abrasive article 22 is normally held constant.

Various methods for quantifying the performance of the abrasive article are possible within the scope of the present invention. Such methods can include the establishment and maintenance of primary standard workpieces and secondary working standards and/or the retention of standard abrasive articles for the periodic calibration of the working standards. Other calibration methods, such as those based upon the determination of the specific energy of grinding may also be used. Once the performance index has been determined, it may be marked on the article (e.g., by marking the face or another surface of the article), or it may be placed on the article's packaging or it may be associated with the article in some other way.

The performance index itself may actually be the cut rate of the article 22 determined as described hereinabove, or it may be a value derived from the cut rate. It may be, for example, a cut rate normalized to an arbitrary standard or to the process average. This may be expressed as a ratio or as a percentage. The index may be presented as the reciprocal of such a ratio or percentage to facilitate the computation of the desired initial operating conditions. The value of the index may be presented as a single value of a continuous variable or it may be represented as a discrete value indicating that the measured value fell within a corresponding range.

Through the characterization of the abrasive article 22, an end user can insert a new or replacement article into an established grinding or polishing operation using the performance index to initially adjust his/her process conditions and/or settings in a manner that will provide a desired level of performance from the new abrasive article. For example, the performance index allows the user to preset conditions in his/her process that will provide a desired cut rate, surface finish or the like. Based on the performance index, the end user may adjust one of the process conditions of the grinding or polishing operation such as the grinding time (e.g., at constant pressure, constant speed), or the pressure at which the abrasive article 22 is applied against a workpiece (e.g., assuming constant grinding speed and a predetermined grinding time) or the speed of the abrasive surface (e.g., assuming constant pressure and a predetermined grinding time). One may also adjust a combination of process parameters to attain the desired result. The performance index is unique to each abrasive article and is directly associated with the abrasive article. In this manner, the index provides information that will enable the end user of the abrasive article to understand how the performance of that abrasive article compares to that of a second abrasive article.

Abrasive processing conditions and the abrasive performance properties include grinding or polishing pressure (the pressure at which the abrasive article is applied against the workpiece), velocity (the speed of the abrasive surface relative to the surface of the workpiece), cut (the total mass of material abraded from a workpiece), elapsed time (the time during which grinding or polishing takes place) and cut rate (the mass of material abraded per unit of time). These conditions and properties can be plotted against one another. Typically, these plots are linear and have a y-intercept at (0,0). Because of this linear relationship, the performance indices associated with a pair of abrasive articles and which are based on such processing conditions and/or performance properties can be used to predict the relative performance of abrasive articles in an abrasive processing line.

The performance index may represent the cut rate (mg/min) for the abrasive article operated under a first set of process conditions "X" and utilizing a workpiece "A." Thereafter, performance indices may be compared to one another (e.g., by ratio) to determine the relative performance of old and new abrasive articles (e.g., worn and replacement articles), thus allowing for an initial adjustment of process conditions prior to the use of a new article in an existing process line. A performance index may be expressed as a relative cut rate such as with a ratio to the cut rate of a standardized abrasive article or to a process average for a group of related abrasive articles or as a percentage, or as a scaling factor which is derived from the measured cut rates and which indicates the adjustment necessary to attain a standard performance. Some forms of the index can be used by simply multiplying a value for a standard operating parameter by the index to obtain a corrected operating parameter necessary to achieve consistent performance.

It may be preferable to use the same measure for the performance index for any of a variety of abrasive processes. However, in some cases, it may be desirable to have a second performance index that can be marked or labeled on the product. A second index may be desired when it is known that a first performance index, while correlating well with a first abrasive process, does not correlate well with a second abrasive process. Additionally, end users of the abrasive articles may prefer to have the performance index based on one abrasive property such as, for example, the abrasive cut rate in processing a first material while a second end user may prefer a performance index based on the useful life of the abrasive article in abrading a second and completely different material. In the foregoing situations, it may be desirable to mark an abrasive article with both of the indices.

Abrasive processing of nominally brittle materials is described by the Preston Equation (I):

$$dz/dt=(K\cdot N\cdot ds)/A\cdot dt \quad \text{(I)}$$

where "z" is the amount of material removed, "K" is a constant characterizing the interaction between the abrasive article and the workpiece, "N" is the normal force, "s" is the sliding distance, and "t" is time. "A" may be the real contact area between the abrasive grains and the workpiece or it may be the area (cross-section) of the groove swept by the grain. Either of the foregoing definitions for "A" is the equivalent to the other and may be used in the foregoing equation. It will be appreciated that the different definations of 'A' will result in different numerical values for K.

Equation (I) is often recast in the form of equation (II):

$$Z=K\cdot P\cdot V\cdot t \quad \text{(II)}$$

where the amount of material removed (Z) is the product of the constant (K), the pressure (P) and the total distance of sliding contact is Velocity (V) x time (t). Accordingly, reducing the pressure by 50% will reduce the amount of material removed by 50%. Alternatively, reducing the total distance of sliding contact, for example by halving either the sliding velocity or the sliding time, will also reduce the amount of material removed by 50%. Similarly, any combination of altered pressure, velocity, and time which results in a 50% reduction of their product under equation (II) will result in a 50% reduction in the amount of material removed. A change in the workpiece or the material to be abraded by an abrasive article will change the value of "K" without changing the aforementioned linear, proportional behavior. Even in abrasive process systems which do not strictly obey the Preston Equation, assumed Prestonian behavior provides a useful approximation of the process conditions needed upon the replacement of an abrasive article within such a process.

The ratio of the performance indices (and their relative performance) of two abrasive articles against the same workpiece under conditions "X" will be substantially the same as the ratio of those same two abrasive articles against a different workpiece under conditions "Y" so long as the articles, workpieces, and conditions are suited for abrasively working the respective workpieces. Thus if article "A" cuts 10% more from the urethane test puck under conditions "X" than article "B" cuts from the urethane puck under conditions "X", it is also expected that article "A" will cut 10% more from a copper workpiece under conditions "Y" than article "B" will cut from a copper workpiece under conditions "Y". Similarly, article "B" can be made to abrade copper at a rate equivalent to that observed for article "A" by increasing the pressure over that used at conditions "Y"

in the ratio of 110/100, or by a 10% increase in pressure. Alternatively, equivalent material removal may be realized by increasing the abrasion time by the same ratio. Finally, the rate at which the abrasive moves past the workpiece may be increased according to the foregoing ratio.

Because the relationships between pressure, velocity and time are well known and generally linear, any two of the parameters or even all three parameters may be varied in linear combination to achieve the same result, a 10% increase in the amount of material removed by article "B" under conditions "Y." Similar considerations apply if article "C" cuts 10% less material from the urethane workpiece under conditions "X" than article "B" cuts from the urethane workpiece under conditions "X." When this information is applied to cutting copper under nominal conditions "Y" one could cause article "C" to cut copper at a rate equivalent to either article "A" or article "B" as desired by altering the use conditions "Y" in the ratios of 110/90 or 100/90, respectively. Alternatively, one could reduce the pressures (time, velocity, or combinations of any two or all three) to cause articles "A" or "B" to perform like article "C" in a predictable manner.

For convenience, the index may be a simple cut rate, a normalized cut rate, or the result of a function, such as the inverse of either measurement. Instructions may be included with each of the abrasive articles, and those instructions will differ depending on the marking chosen. In another embodiment, articles with similar performances could be grouped together and assigned a letter or other code such as A, B, C, D, or E. In this case, an instruction associated with the abrasive article might direct the end user to operate abrasive articles marked with an "A" at a normal pressure 6% higher than the process average in order to obtain nominal performance. Articles marked with a "B" may need to be operated at a normal pressure which is 3% higher than the process average. Articles marked with a "C" may need to be operated at the process average. Articles marked with the letter "D" may need to be operated at a normal pressure 3% lower than the process average. Finally, articles marked "E" may need to be operated at a normal pressure 6% lower than the process average.

In still other embodiments, the particular grinding or polishing system may be relatively insensitive to one of the process variables. For example, the surface finish provided to metal articles by a lofty nonwoven having abrasive particles coated on the individual fibers may be relatively insensitive to the applied pressure because pressure to the article may compress the article rather than altering the penetration of the individual grains into the metal surface. In that case, instructions to the user would limit corrective adjustments to the variables of velocity and time. In still other embodiments, the relationship between cut rate or surface finish and the three independent variables of pressure, relative velocity, and time may not be sufficiently linear to capture in the manner described above. In those cases, nonlinear functions may be preferred. Those functions may require that the article be marked with more than one parameter or index and that the user be provided with a more complex function to calculate the desired operating conditions.

Referring now to FIG. 2, another embodiment of an apparatus according to the invention is illustrated in schematic. The apparatus 120 is generally intended for use as part of a manufacturing line for an abrasive web 122. As shown, the web 122 travels downstream in a manufacturing process with the web maintained at a predetermined web speed. A feed roll 124 moves the web 122 downstream while also providing a support for the web 122 at or near the apparatus 120. The feed roll 124 moves the web 122 past apparatus 120 for further processing in the manufacturing process. The web 122 may be wound onto a take-up roll (not shown) for storage or further processing at another location. According to the present invention, the web 122 is marked with a performance index after the web 122 has traveled downstream from the apparatus 120. As discussed above, the performance index indicates the abrasive performance of the abrasive web 122. Because the web 122 is generally a continuous sheet of abrasive material, it is contemplated that a performance index for an abrasive web would be applicable to a predetermined length thereof. Consequently, the invention contemplates the calculation or determination of multiple performance measurements for a lengthy and continuous abrasive web.

Apparatus 120 is configured for movement between a first position and a second position. In a first position, the web 122 contacts first end 134 of workpiece 132, as shown in FIG. 2. As is described herein, the apparatus 120 provides a second position in which the web 122 and the workpiece 132 are out of contact with one another (not shown). Those skilled in the art will appreciate that other relative positions for the web 122 and the workpiece 132 may be needed or desired, and the invention is not intended to be limited to two such relative positions. In the depicted embodiment, apparatus 120 comprises a head portion 126 mounted on a shaft 128. The shaft 128 is affixed to a pivot arm 130. In this configuration, the head portion 126 is positionable between the foregoing first and second positions by pivoting the shaft 128 and the head portion 126 on pivot arm 130. In the first position, the head portion 126 is placed near the web 122 with the first end 134 of workpiece 132 in contact with the abrasive surface of the web 122. In this position, a measurement of the performance index may be obtained. In a second position, the head portion 126 and the shaft 128 are pivoted on pivot arm 130 away from the web 122. In this first position, and the apparatus 120 is disengaged from the measurement of the performance index.

The head portion 126 of the apparatus 120 provides a test device that holds the workpiece 132 in a preferred position so that the first end 134 of the workpiece 132 is in a position to contact the abrasive surface of the web 122 when the pivot arm 130 and the shaft 128 (positioning means) hold the head portion 126 in the second position. The workpiece 132 is a rod-shaped article with an abradable first end 134 and a second end 136 opposite the first end 134. The first end 134 of the workpiece may be held in a non-contact position relative to the abrasive web 122 when the head portion 126 is maintained in a first position by the pivoting of the pivot arm 130 and shaft 128 so that the head portion 126 is adjacent to the web 122. In this position, the first end 134 of the workpiece 132 is in direct contact with an abrasive surface of the web 122 wherein the first end 134 of the workpiece 132 is an abradable surface.

The workpiece 132 is retained within the head portion 126 by a first retaining means comprising reversibly rotatable feed rolls 138, 140 and a metered orifice or retaining bracket 148. The rotation of rolls 138, 140 is controlled by servo motor 142. The rolls 138, 140 serve to both hold and to advance the workpiece 132 toward the web 122. Retaining clip or a metered orifice 148 is provided on the head portion to assist in supporting the first end 134 of the workpiece 132. The second end 136 of the workpiece 132 projects beyond the head portion 126 in the opposite direction of the first end 134. The workpiece 132 may be continually or intermittently advanced through the feed rolls 138, 140 as the workpiece is abraded at the interface of the web 122 and the first end 134. In the depicted embodiment, the roll 124 serves as a second retaining means to retain the web 122 in a predetermined orientation with respect to the head portion 126. An electronic sensor, such as the position sensor 144, may be associated with the head portion 126 to detect the distance from the head portion 126 to the abrasive web 122. Controller 146 is shown in schematic as one means by which the output from the sensor 144 is processed to controllably drive the feed rolls 138, 140 and thereby advance the workpiece 132 so that a constant distance is maintained between the head portion and the web 122.

The web 122 is driven by one or more motorized drives (not shown) which serve as a means for moving the abrasive web 122 relative to the workpiece to facilitate the grinding or polishing of the workpiece 132. A cut rate may be calculated by measuring the change in the length of the workpiece 132 for a certain length of web 122. Thereafter, a performance index may be calculated in the manner set forth herein and then marked on the appropriate length of the web 122 further downstream from the apparatus 120.

Figure 3:
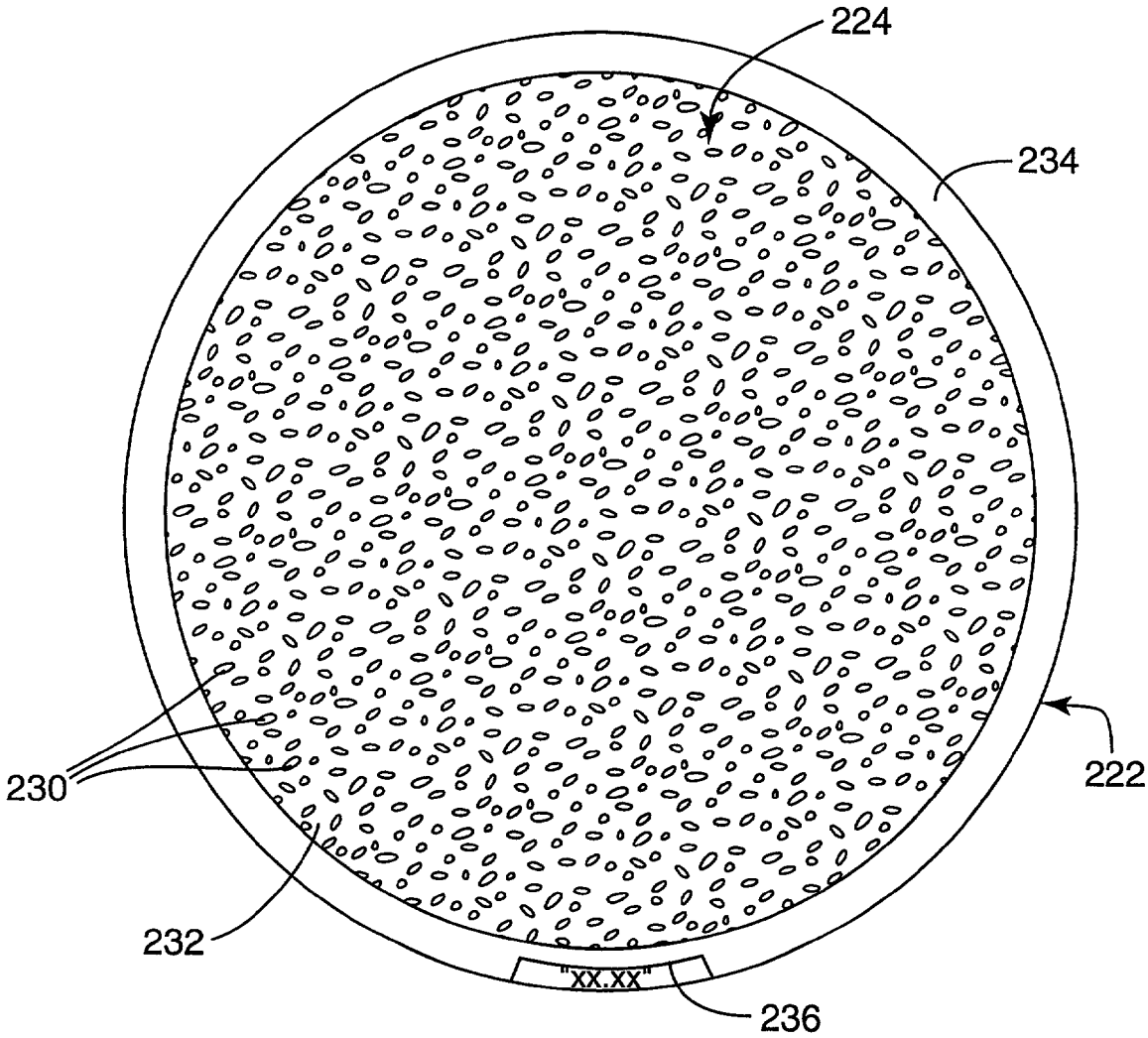
FIG. 3 is a plan view of an abrasive article bearing a performance index according to an aspect of the invention.
Figure 4:
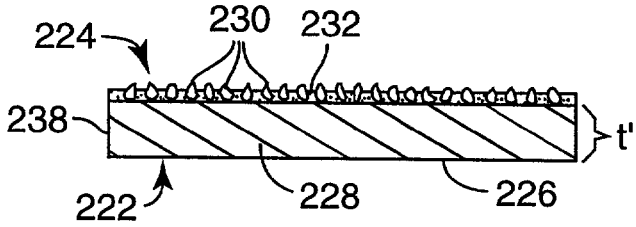
FIG. 4 is a side elevation of the abrasive article of FIG. 3.

Referring to FIGS. 3 and 4, an abrasive article is depicted in the form of a pad conditioner or conditioning disk 222 constructed to condition conventional slurry pads used for the chemical mechanical planarization of silicon wafers. The disk 222 is exemplary of one type of abrasive article that may include a performance index according to the present invention. The disk 222 includes a substrate 228 formed from a suitable material such as stainless steel, for example. The substrate 228 has a thickness 't' with a first major surface 224 and a second major surface 226. The first major surface 224 is an abrasive surface comprising a plurality of abrasive particles 230 at least partially embedded in a matrix material or binder 232. A particle free zone 234 is provided along the peripheral edge of the first surface 224. In the depicted article 22, a performance index is provided within the area 236 in the particle free zone 234 on the first surface 224. The performance index may be directly readable by the end user, for example, or it may be encoded in machine readable form (e.g., as a bar code). Hence, the performance index may be directly encoded or it may reside in a database which may be interrogated using an identifier for the abrasive article, such as a serial number, that associates the measured performance index with the abrasive article.

While the performance index within the area 236 is shown affixed or associated with the first surface 224 of the article 222, it will be appreciated that a performance index may be associated with the abrasive article 222 in another manner such an by associating the index with the second major surface 226. On an article such as the pad conditioner 222, the substrate 228 may be of sufficient thickness so that the index can be associated to the article 222 along the side 238 having a thickness 't.' The performance index may be associated with the abrasive article in any manner available to those skilled in the art. One manner of affixation may be preferred over another depending on the nature of the abrasive article, the materials used in its construction, the relative expense of different means for affixation and the availability of equipment needed to mark an abrasive article with the performance index. Additionally, the performance index of the invention may be associated with an abrasive article by printing or otherwise marking an article's packaging such as by the affixation of a label to the individual packaging used for the shipment and or the commercial display of the abrasive article. It should be apparent that the present invention is by no means limited to any particular manner of associating a performance index with an abrasive article.

In the discussed embodiments, the performance index is related to the cut rate of the abrasive article on the test workpiece. In such cases, the relationship between force and cut rate is expected to be approximately the same on the equipment of the end user as on the apparatus used in the determination of the performance index. In instances where the workpiece materials used in the grinding or polishing operations of the end user are different than that used to determine the performance index, the end user may need to calibrate his/her equipment to first establish a relationship between the performance index and cut rate, for example. Subsequently, the performance index for each abrasive article supplied to the end user may then be matched to a known cut rate based on the aforementioned standardization.

Additionally, a performance index may be determined during the manufacturing process for each of several different workpiece materials. For example, if the abrasive article is to be used on steel in one application and on glass in another application, the maker of the abrasive article may provide a separate performance index for each of the two different workpiece materials, however this usually will not be necessary since a single index will be applicable to many different workpiece materials under various operating conditions.

Where the abrasive article is provided as an abrasive web, the indicia printed on the web will typically represent the average cut rate (or other property) over a length of the web. The length used would be chosen by one skilled in the art to take into account the normal variation for the abrasive tested and the application for the abrasive. A short averaged span and faster web speeds would in general require faster and more automated test equipment.

The performance index is marked on the article or on its associated packaging and may be encoded for competitive reasons. The performance index may also be associated with the workpiece through a connecting database. For example, the article or its packaging may bear a serial number or other identifier which is then used as a look up key in a local or remote database. The look up process may be automated such that the apparatus which uses the abrasive article reads an identifier associated with the article or the packaging for the article and then performs the look up in a local or remote database to obtain the performance index associated with that abrasive article. Preferably, if the apparatus reads either the performance index directly or obtains it by look up, it will then adjust at least one of pressure, velocity, or time without operator intervention It will be appreciated that the above described embodiments of the present invention are illustrative but not inclusive of all possible embodiments. For example, the use of cut rate to provide a performance index is only one manner of practicing the invention. Other performance indices can be determined based on, for example, a measured finish imparted to the workpiece in a testing apparatus to be included in the manufacturing process for the subject abrasive article. Additional details of the preferred embodiment are set forth in the following non-limiting examples.

EXAMPLES

Example 1

An abrasive article provides a cut rate 10% higher than the known average for the same type of abrasive article in the same type of abrasive application. The abrasive article is assigned a performance index of 1.10 and so marked. In use, the force to be applied to urge the abrasive article against the workpiece is calculated to be the ratio 1/1.10 or 0.91 of the applied force used in determining the average cut rate. Applying the calculated 1.0 force results in a cut rate which closely approximates the cut rate of an article which is representative of the process average for the abrasive article manufacturing process.

Example 2

The performance index is the inverse of the cut rate and is described as an adjustment factor. The cut rate is measured to be 10% higher than average. The index is 1/1.10=0.91 and the article is so marked. The user of the abrasive article reduces the applied normal force against the abrasive to 91% of the nominal force and obtains a cut rate which closely approximates the cut rate of an article which is representative of the process average for the abrasive article manufacturing process.

Although the measured performance of the two articles is the same, the marked performance index values applied in Example 1 is 1.10 because division is performed to obtain the operating parameter while multiplication is used in Example 2 to obtain the performance index 0.91. Other markings may also be used to indicate the performance of the articles in Examples 1 and 2 such as "110" and "91," or "220" and "182" or even "55" and "45.5." The numerical value used for the performance index is not important as long as the user is instructed on how to use the marking.

Example 3

An abrasive article provides a desired surface finish on a workpiece, at a predetermined working pressure, in 10% less time than the known average for that type of abrasive article in the same type of abrasive application. The abrasive article is assigned a performance index of 1.11 and is so marked. In use, the time (e.g., in seconds) during which the abrasive article is to be urged against a workpiece is calculated as the ratio 1/1.11 or 0.90 (90%) of the time required to attain a surface finish equivalent to the finish obtained using an abrasive article representative of the process average.

Example 4

An abrasive process uses air pressure in a pneumatic cylinder to urge an abrasive article against a workpiece. An approximate air pressure (the "nominal pressure") is known on average to provide a desired cut rate. A performance index on the abrasive articles is to be used to reduce existing variability when fine tuning the amount of pressure exerted against the abrasive article. However, it is known that the process equipment exerts a so-called "dead" load in that the equipment provides a fixed, nonzero force against the workpiece even when no pressure is exerted from the pneumatic cylinder. Hence, the process described in this example provides a method to determine an appropriate pressure setting for the pneumatic cylinder that takes into consideration the non-zero cut rate with in the absence of any pneumatic pressure.

Three abrasive articles, each marked with a performance index based on cut rate, are selected and the cut rate for each of the three abrasive articles is determined against a workpiece at applied pressures of 0.5, 1.0, and 1.5 times the nominal pressure (e.g. "70" in this Example). The cut rate data is set forth in Table 1.

TABLE 1

| Article | Relative Air Pressure | Relative Cut Rate | Marked Performance Index | Ratio of Cut Rate to Performance Index |
|---|---|---|---|---|
| A | 35 | 1.76 | 1.10 | 1.60 |
| B | 70 | 1.60 | 0.80 | 2.00 |
| C | 105 | 2.16 | 0.90 | 2.40 |

The measured cut rates are corrected to account for the relative aggressiveness of the abrasive articles as shown by their performance indices. The observed cut rate is divided by the performance index for each of the abrasive articles. The calculation takes into account the non-zero intercept (showing a positive pressure in this case) for the equipment used and may be used to determine appropriate applied pressures for new articles.

A least squares regression analysis is used to determine a best fit in a plot of (1) pressure vs. (2) the ratio—cut rate/performance index ("cut/P.I."). The linear plot (in slope-intercept format) is defined by equation (1):

$$\text{cut/P.I.}=0.0114\times\text{pressure}+1.200 \quad (1)$$

The cut rate is given by equation (2):

$$\text{cut rate}=\text{P.I.}\times(0.0114\times\text{pressure}+1.200) \quad (2)$$

To achieve a cut rate of 2.00 the pressure is determined according to equation (3):

$$\text{pressure}=((2.00/\text{P.I.})-1.200)/0.0114 \quad (3)$$

Hence, if the performance index on a new abrasive article is 0.85 then the air pressure needed to obtain a desired cut rate of 2.00 would be determined using equation (3), as follows:

pressure=((2.00/0.85)−1.200)/0.0114; or pressure=101.

As long as the relationship between cut rate and the applied pressure is approximately linear through a range of pressures useful in the abrasive process, the method illustrated in this example will help to reduce the variability in the abrasive process.

Example 5

Two different grinding machines were used. The first machine (the "test machine"), was a modified lapping machine available from Gerber-Coburn, Muskogee, Okla. under the trade designation "Coburn Rocket model 507. The test machine was used to determine cut rates characteristic of two lots of abrasive. The second machine (the "production machine"), was used as representative of an actual abrasive process to demonstrate reduced variability in the abrasive process through the use of abrasive articles marked with a performance index that was based on cut rate.

A polishing experiment was performed on the test machine using a lapping film as the abrasive article. The lapping film was obtained from Minnesota Mining and Manufacturing Company, St. Paul, Minn. and is commercially available under the trade designation "272L". The lapping film comprised aluminum oxide abrasive particles having an average size of about 60 micron.

A lapping operation was performed on the test machine to polish the end surface of a 1018 steel ring having 5 cm outer diameter, a 4.44 cm internal diameter and measuring 1.27 cm long. The lapping film was cut to provide a 10.2 cm abrasive disk which was then affixed to a flat aluminum plate with double sided tape. Lubricant (5551A Honing oil from Castrol Industrial North America, Downers Grove Ill.) was added to the surface being polished at the rate of about one drop per second, and the steel workpiece was urged against the lapping film using a force of 133 Newtons during a total run time of one minute. The cut rate was determined by measuring the mass of the steel removed from the ring. The cut rate data was normalized with respect to the cut rate for the lot 1 abrasive articles. The normalized cut was then used as the performance index for the respective abrasive articles. The cut rate data is set forth in Table 2.

TABLE 2

| Lot | test 1 | test 2 | average | Performance Index (Normalized Cut) |
|---|---|---|---|---|
| 1 | 0.4739 | 0.4926 | 0.48325 | 1.000 |
| 2 | 0.6004 | 0.6622 | 0.6313 | 1.306 |

The production machine was built to duplicate the basic features of a machine used to polish steel journals. The machine polished the outside round surface of a steel ring (1018 steel, 5 cm outer diameter×1.9 cm wide) using an abrasive strip (1.27 cm wide). The abrasive was urged against the workpiece with a pressure shoe. Friction between the non-abrasive side of the abrasive and the shoe held the abrasive stationary with respect to the shoe. The shoe was oscillated parallel to the axis of the ring, with an amplitude of 0.32 cm at 230 oscillations per minute. The steel ring was clamped on a shaft and was rotated at 60 rpm. A short length of abrasive was held against the ring as it rotated clockwise for 7 seconds and then counter-clockwise for another 7 seconds. An air cylinder was used to apply force to the abrasive article and urge it against the steel ring. A diluted lubricant was added to the interface between the ring and the abrasive article. The lubricant was obtained commercially under the trade designation "Cimtech 500" (Milacron Marketing Co, Cincinnati, Ohio) and diluted with water to a 95/5 weight ratio (water/lubricant). The pressure on the abrasive was 1.767 times the applied air pressure. The length of abrasive contacting the workpiece was about 3.3 cm long. The cut was determined by measuring the mass in grams removed from the outer diameter of the steel ring in one cycle.

The production machine process was tested to see if the cut rate was linear with respect to the air pressure using the standard Lot 1. Data is set forth in Table 3.

TABLE 3

| Pressure (kPa) | Cut (g) |
|---|---|
| 138 | 0.0354 |
| 207 | 0.0465 |
| 207 | 0.0477 |
| 207 | 0.0487 |
| 276 | 0.0548 |
| Slope | 0.00141 |
| Intercept | 0.01752 |
| r | 0.974 |

Having confirmed that the cut was linear with applied pressure (as indicated by r=0.974), an end user can now calculate use conditions directly from the performance index for future marked articles. Similar calculations are available for abrasive processes based on relative velocity, grinding or polishing time, or based on a combination of pressure, velocity, and time, for example.

The production machine's applied normal force was 207 kPa in the air cylinder for abrasive with a normalized cut of 1.00. The 207 kPa data from above showed an average cut of 0.0476 grams. Abrasive articles from lot 2 were then used in the foregoing grinding process on the production machine. Grinding data was first obtained using the lot 2 abrasives with the grinding pressure and other process conditions remaining the same as those used for the lot 1 abrasive articles. Data is set forth in Table 4.

TABLE 4

| | Cut (g) |
|---|---|
| | 0.0559 |
| | 0.0526 |
| | 0.0516 |
| average | 0.0534 |
| std dev. | 0.0023 |

The production machine was then run with the pressure adjusted to compensate for the performance index associated with lot 2. The air pressure was adjusted to be 207×1/1.306=158 kPa. The resulting grinding data is set forth in Table 5:

TABLE 5

| | Cut (g) |
|---|---|
| | 0.0453 |
| | 0.0442 |
| | 0.0467 |
| average | 0.0454 |
| std dev. | 0.0013 |

The desired cut of the process was 0.0476 grams per production pass which is the nominal performance for the standard lot no. 1. As is set forth in Table 6, compensating for the air pressure by use of the performance index reduced the overall process variability from 12.2% to 4.6%.

TABLE 6

| | Lot 1 (Standard) | Lot 2 | Lot 2 adjusted |
|---|---|---|---|
| | 0.0476 | 0.0534 | 0.0454 |
| % error from standard | 0 | 12.2 | 4.6 |

It will be appreciated that while the preferred embodiment of the invention has been described above, changes or modifications to the described embodiments are within the skill of those practicing in the field, and that such changes and modifications are within the scope of the invention, as further defined in the following claims.

What is claimed is:

1. A process for characterizing the performance of an abrasive article for abrading a workpiece, the workpiece comprising a first material and having an abradable surface, the process comprising:

(a) providing an abrasive article having an abrasive surface;

(b) providing a test workpiece comprising a second material different than the first material and having an abradable surface thereon;

(c) abrading the abradable surface of the test workpiece by applying the abrasive surface against the abradable surface of the test workpiece at a known applied pressure and velocity and relatively moving the abrasive article and the abradable surface of the test workpiece during a predetermined period of time; and (d) devising a performance index for the abrasive article based on performance of the abrasive article during the abrading of the test workpiece in step (c) which can be associated with process conditions under which the abrasive article can be used to abrade the abradable surface of the workpiece.

2. The process of claim 1 wherein the devising of a performance index in step (d) comprises determining the cut rate for the abrasive article following the completion of the abrading step (c) and thereafter devising the performance index based on the cut rate.

3. The process of claim 1 wherein the performance index is a ratio of the cut rate to any of (i) the applied pressure, (ii) velocity or (iii) the predetermined period of time.

4. The process of claim 1 wherein the devising of a performance index in step (d) comprises measuring the finish on the abradable surface of the test workpiece following the completion of the abrading step (c) and thereafter devising the performance index based on the measured finish on the abradable surface of the test workpiece.

5. The process of claim 1 wherein the performance index is provided on the abrasive surface of the abrasive article.

6. The process of claim 1 wherein the abrasive article further comprises a non-abrasive surface and the performance index is provided on the non-abrasive surface of the abrasive article.

7. The process of claim 1 wherein providing an abrasive article comprises packaging the abrasive article in a package, and wherein the performance index is provided with the package.

8. The process of claim 1 wherein the performance index is stored in a database, and a marking is associated with the abrasive article, the marking providing a means for interrogating the database to obtain the performance index therefrom.

9. The process of claim 8 wherein the marking is in machine readable format.

10. The process of claim 8 wherein the marking is in alpha-numeric format.

11. The process of claim 8 wherein the marking is a bar code.

* * * * *

UNITED STATES PATENT AND TRADEMARK OFFICE

CERTIFICATE OF CORRECTION

PATENT NO. : 7,160,173 B2
APPLICATION NO. : 10/115538
DATED : January 9, 2007
INVENTOR(S) : Gary M. Palmgren It is certified that error appears in the above-identified patent and that said Letters Patent is hereby corrected as shown below:

Column 8
Line 29, delete “definations” and insert --definitions--

Column 12
Line 50, after “intervention” insert --.--

Column 13
Line 6, after “calculated” delete “1.0”

Column 17
Line 16, delete “claim 1” and insert --claim 2--

Signed and Sealed this

Tenth Day of April, 2007

JON W. DUDAS
*Director of the United States Patent and Trademark Office*